US012635786B2

(12) United States Patent
Ozga

(10) Patent No.: US 12,635,786 B2
(45) Date of Patent: May 26, 2026

(54) CUP HOLDER FOR CONNECTING TO LUGGAGE RAILS OF VARIOUS SIZES

(71) Applicant: Brianna Ozga, Grosse Pointe, MI (US)

(72) Inventor: Brianna Ozga, Grosse Pointe, MI (US)

( * ) Notice: Subject to any disclaimer, the term of this patent is extended or adjusted under 35 U.S.C. 154(b) by 0 days.

(21) Appl. No.: 18/929,873

(22) Filed: Oct. 29, 2024

(65) Prior Publication Data

US 2026/0114599 A1 Apr. 30, 2026

(51) Int. Cl.
*A45F 5/00* (2006.01)
*A45C 5/14* (2006.01)
*A45C 13/26* (2006.01)

(52) U.S. Cl.
CPC ..... *A45F 5/00* (2013.01); *A45C 5/14* (2013.01); *A45C 13/262* (2013.01); *A45C 2013/267* (2013.01); *A45F 2005/002* (2013.01); *A45F 5/1583* (2025.01)

(58) Field of Classification Search
CPC ..... A45C 13/28; A45F 5/00; A45F 5/1583
USPC ..... 190/102; 248/311.2, 229.23; 220/738, 220/737
See application file for complete search history.

(56) References Cited

U.S. PATENT DOCUMENTS 232,461 A * 9/1880 Coolbaugh ..... H01Q 1/1221 248/539
2,979,301 A * 4/1961 Reveal ..... A47G 23/0216 220/737
4,596,370 A * 6/1986 Adkins ..... B62J 11/04 224/454
4,634,089 A * 1/1987 Wright ..... B60N 3/103 248/205.2
4,826,058 A * 5/1989 Nakayama ..... B60N 3/102 224/281
D328,216 S * 7/1992 Steed ..... D6/567
D355,337 S * 2/1995 Eisenbraun ..... D7/620
5,400,990 A * 3/1995 Frankel ..... B62J 7/08 211/74
5,425,484 A * 6/1995 Kawand ..... B65D 81/3886 224/454
5,464,183 A * 11/1995 McConnell ..... B62B 9/26 224/407
5,522,527 A * 6/1996 Tsai ..... B62J 29/00 224/558
5,740,951 A * 4/1998 Jack ..... A45F 5/02 224/148.1
5,803,327 A * 9/1998 Nipper ..... A61H 3/02 224/407
5,966,865 A * 10/1999 Jones ..... A47G 7/044 248/230.8
6,029,938 A * 2/2000 Fava ..... A47G 23/0225 224/222

(Continued)

*Primary Examiner* — Steven A. Reynolds
*Assistant Examiner* — Prince Pal
(74) *Attorney, Agent, or Firm* — Gregory Lawrence Ozga

(57) ABSTRACT

A cup holder for use with luggage having rails. The cup holder has a bottom surface, an open top and a body wall extending between the bottom surface and the open top. The body wall includes an inner surface defining a cavity for receiving a beverage container and an outer surface. Inside of the cavity there are a plurality of cup stabilizers extending from the inner surface of the body wall to contact and hold the beverage cup. There are a plurality of clamps extending from the outer surface of the body wall that are used to connect the cup holder to the rail on the luggage.

5 Claims, 4 Drawing Sheets

(56) References Cited

U.S. PATENT DOCUMENTS 6,264,153 B1 * 7/2001 Ragner ..... B62B 9/26 224/482
6,338,419 B1 * 1/2002 Penney ..... A47G 7/06 220/475
6,390,431 B1 * 5/2002 Ott ..... F16M 13/022 248/229.23
6,644,524 B1 * 11/2003 Garvin ..... B62B 3/1472 248/311.2
7,404,534 B1 * 7/2008 Hajianpour ..... A45F 5/02 248/248
7,954,773 B2 * 6/2011 Carnevali ..... B60N 3/103 248/314
8,210,392 B2 * 7/2012 Kang ..... B65D 25/2847 220/737
8,235,190 B2 * 8/2012 Porte ..... A45F 5/00 248/104
8,307,966 B2 * 11/2012 Cummins ..... A47C 7/70 190/102
8,485,680 B2 * 7/2013 Anderson ..... B60Q 3/64 362/101
8,870,044 B1 * 10/2014 Freese ..... A47D 15/00 248/104
9,241,554 B1 * 1/2016 Tong ..... A45C 13/00
9,545,355 B1 * 1/2017 Welch ..... H04B 1/3888
9,561,745 B2 * 2/2017 Sawada ..... B60N 3/101
9,700,164 B2 * 7/2017 Klugh ..... A47G 23/0225
9,944,209 B1 * 4/2018 Carnevali ..... F16M 11/2028
10,022,006 B1 * 7/2018 Williams ..... A47G 29/083
10,143,614 B1 * 12/2018 Pelletier ..... A61H 3/02
10,285,495 B1 * 5/2019 Valme ..... A47B 13/081
10,470,536 B1 * 11/2019 Lundaas ..... A45B 3/00
10,531,755 B1 * 1/2020 Huang ..... F16B 2/12
10,588,812 B2 * 3/2020 Brockway ..... A61H 1/00
10,940,086 B2 * 3/2021 Gitman ..... A61J 1/16
11,071,401 B1 * 7/2021 Krueger ..... A47G 23/0316
11,246,442 B2 * 2/2022 Huff ..... A47G 29/093
11,547,230 B2 * 1/2023 Hsu Besner ..... A47G 23/0225
11,759,038 B1 * 9/2023 Huebner ..... A45F 5/00 220/737
11,759,039 B1 * 9/2023 Cintron ..... A45F 5/1583 220/738
11,819,151 B2 * 11/2023 Baldridge ..... A47G 23/0225
11,903,470 B1 * 2/2024 Feng ..... A45C 13/262
12,075,894 B2 * 9/2024 Reagen ..... A45B 1/00
12,144,414 B1 * 11/2024 Baker ..... A45F 5/00
12,144,444 B2 * 11/2024 Avellanet ..... A45C 15/00
D1,100,600 S * 11/2025 Mizuno ..... D7/619.1
2004/0021048 A1 * 2/2004 Schaal ..... B60N 3/108 248/311.2
2004/0108346 A1 * 6/2004 Pablo ..... A45F 5/021 224/269
2004/0129852 A1 * 7/2004 Giampavolo ..... A47G 23/0225 248/315
2004/0238577 A1 * 12/2004 Shivas ..... A45F 3/16 224/666
2005/0224676 A1 * 10/2005 Stavermann ..... B60N 3/108 248/311.2
2005/0274862 A1 * 12/2005 Takeichi ..... B60N 3/106 248/311.2
2006/0022006 A1 * 2/2006 Cruise ..... A45C 13/001 224/572
2006/0037825 A1 * 2/2006 Dayton ..... A47G 23/0225 190/110
2006/0081750 A1 * 4/2006 Kazyaka ..... B60N 3/107 248/311.2
2007/0089953 A1 * 4/2007 Kohn ..... A45C 5/14 190/102
2008/0011925 A1 * 1/2008 Ruff ..... B60N 3/108 248/311.2
2008/0106054 A1 * 5/2008 Autry ..... B62B 5/06 220/739
2008/0116342 A1 * 5/2008 Oliver ..... A47G 23/0225 248/311.2
2008/0237284 A1 * 10/2008 Peota ..... B62B 3/1472 280/33.992
2010/0051633 A1 * 3/2010 Porte ..... A45C 5/14 190/102
2010/0084531 A1 * 4/2010 Schuchman ..... B60N 3/103 248/311.2
2010/0090079 A1 * 4/2010 Choi ..... B60N 3/106 248/311.2
2010/0200720 A1 * 8/2010 Kaemmer ..... B60N 3/106 248/311.2
2011/0127283 A1 * 6/2011 Delucia ..... B65D 25/22 220/754
2012/0067683 A1 * 3/2012 Cummins ..... A45F 5/00 190/115
2012/0104010 A1 * 5/2012 Kelley ..... B67C 3/14 220/737
2013/0037586 A1 * 2/2013 Richter ..... B62J 11/04 224/401
2013/0126686 A1 * 5/2013 Ballou ..... A45F 3/16 248/205.2
2014/0027477 A1 * 1/2014 deBeers ..... A45F 5/021 224/148.4
2014/0284360 A1 * 9/2014 Chorazewitz ..... A45F 5/02 224/148.7
2014/0284443 A1 * 9/2014 Forbes ..... A47G 23/0216 248/313
2014/0361025 A1 * 12/2014 Gastelum ..... G09F 7/00 220/737
2016/0022032 A1 * 1/2016 Simon ..... A45C 13/28 108/42
2016/0081505 A1 * 3/2016 Berg ..... A45C 13/262 224/401
2016/0227949 A1 * 8/2016 Klugh ..... A47G 23/0225
2017/0086576 A1 * 3/2017 Smith ..... A45C 13/262
2017/0325559 A1 * 11/2017 Johnson ..... A47G 23/0225
2018/0271310 A1 * 9/2018 Klugh ..... A47G 23/0225
2020/0017279 A1 * 1/2020 Quinn ..... B65D 81/3876
2021/0282520 A1 * 9/2021 Weng ..... A45C 13/262
2021/0345746 A1 * 11/2021 Hamaty ..... A45C 5/03
2022/0175166 A1 * 6/2022 Avellanet ..... A45F 5/00
2025/0248509 A1 * 8/2025 Baldi ..... A45F 5/021
2025/0311838 A1 * 10/2025 Baldi ..... A45F 5/021

* cited by examiner

CUP HOLDER FOR CONNECTING TO LUGGAGE RAILS OF VARIOUS SIZES

FIELD OF THE INVENTION

The present invention relates to a cup holder with features for connecting to different sized luggage rails.

BACKGROUND OF THE INVENTION

In the field of air travel, travelers often buy beverages and various food items while at the airport, to enjoy at their gate prior to boarding their plane. With beverages in particular, the seats in the airport terminal often do not have cupholders, have broken cupholders, or are not available due to airport crowding. As a result, passengers end up having to hold their drinks along with their other items. Therefore, there is a need to provide travelers with their own personal beverage holders. It is further desirable to provide travelers with personal cupholders that can be connected to and easily removed from their luggage. It is desirable to provide a cup holder that connects to different sized luggage rails on the piece of luggage.

SUMMARY OF THE INVENTION

The present invention is directed at a cup holder for use with luggage having rails. The cup holder has a bottom surface, an open top and a body wall extending between the bottom surface and the open top. The body wall includes an inner surface defining a cavity for receiving a beverage container and an outer surface. Inside of the cavity there are a plurality of cup stabilizers extending from the inner surface of the body wall to contact and hold the beverage cup. There are a plurality of clamps extending from the outer surface of the body wall that are used to connect the cup holder to the rail on the luggage.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
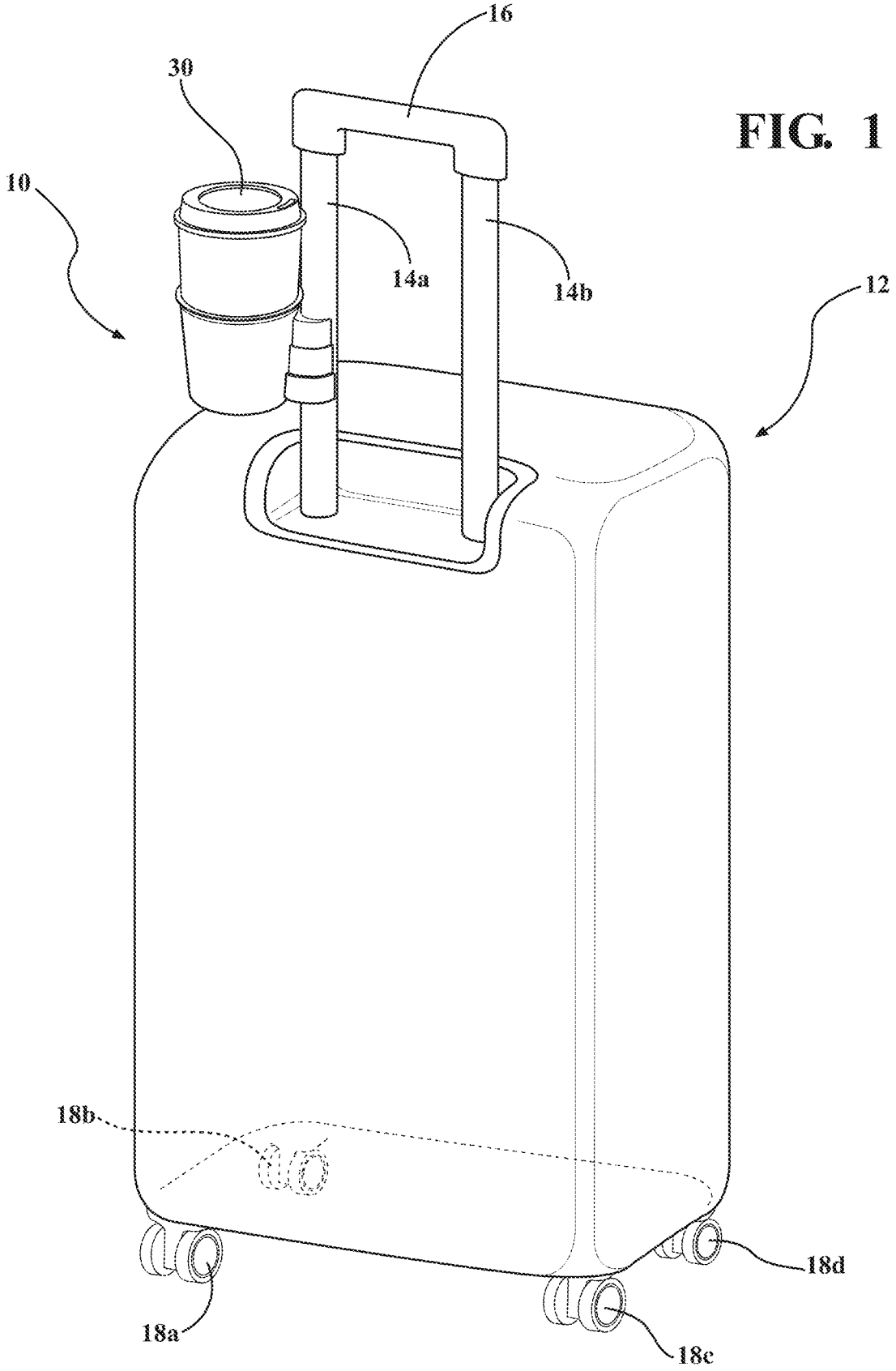
FIG. 1 is a side environmental view of a cup holder connected to a rail on a piece of luggage.
Figure 2:
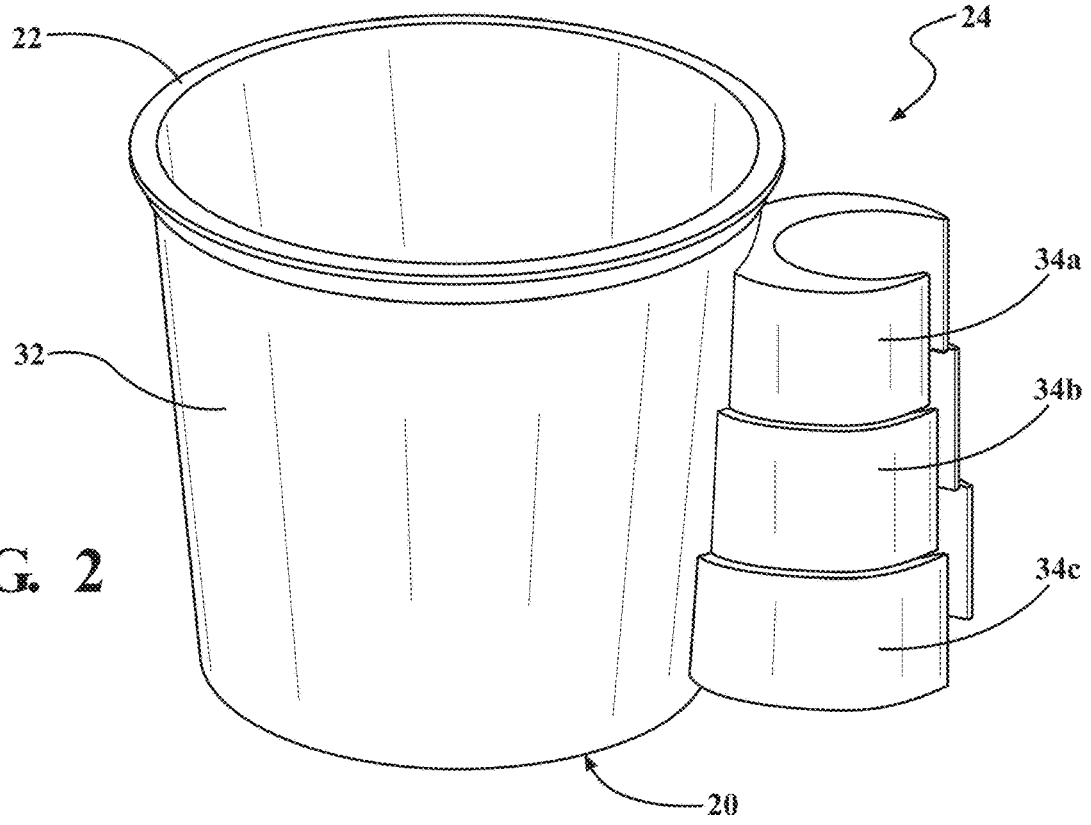
FIG. 2 is an elevational perspective view of the cup holder according to the present invention.
Figure 3:
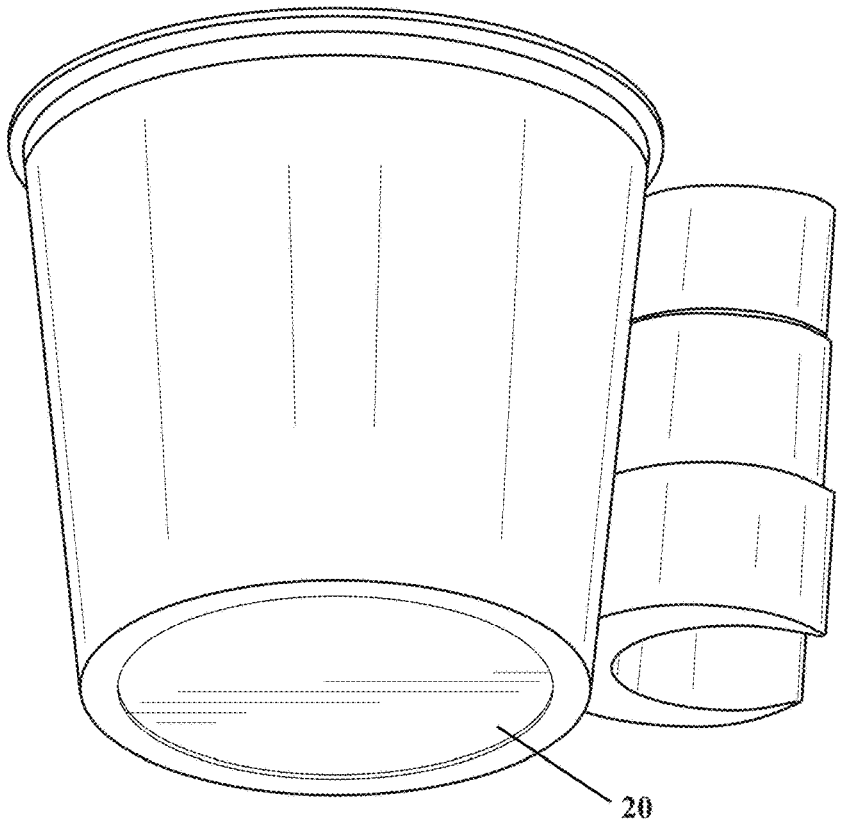
FIG. 3 is a bottom-side perspective view of the cup holder according to the present invention.
Figure 4:
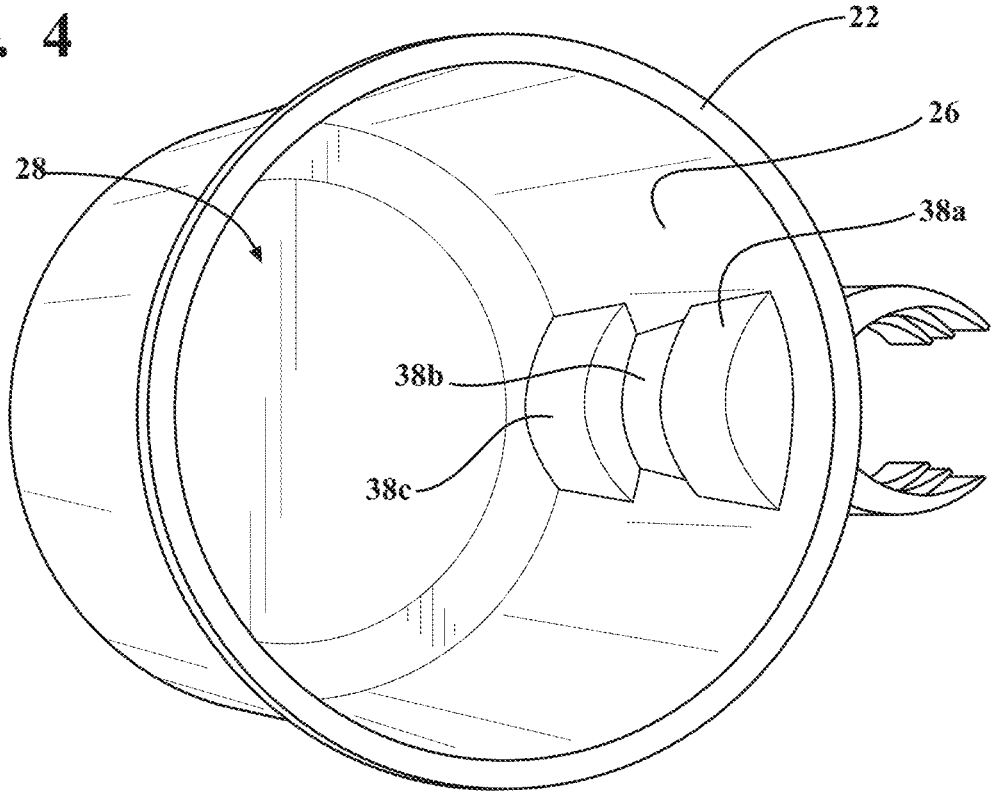
FIG. 4 is a top perspective view of the cup holder.
Figure 5:
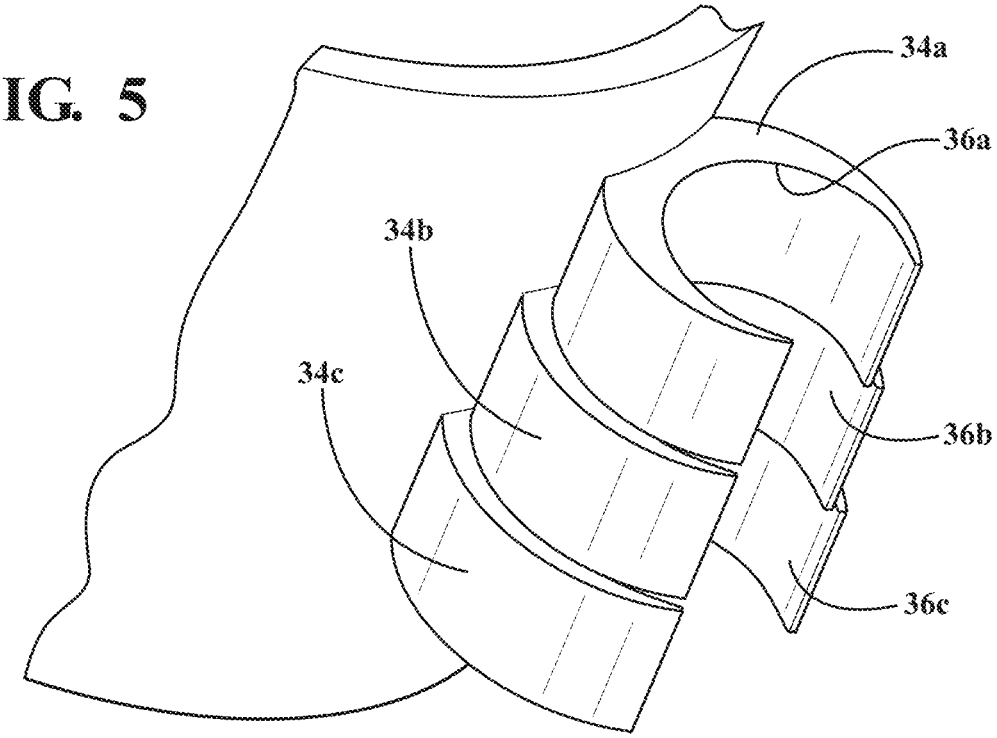
FIG. 5 is an enlarged top view of a portion of the cup holder.

The following description of the preferred embodiments is merely exemplary in nature and is in no way intended to limit the invention, its application, or uses.

Referring now to FIGS. 1-5 a cup holder 10 according to the present invention is shown. Shown in FIG. 1, the cup holder 10 is used for connecting to luggage 12 having one or more extendible rails that are shown as two rails 14*a*, 14*b* that connected to a handle 16 that a user grasps to roll the luggage 12 on wheels 18*a*, 18*b*, 18*c*, 18*d*. As shown, there are four wheels, however, it is within the scope of this invention for there to be at least one wheel that is used to roll the luggage 12. Referring to FIGS. 1-5, the cup holder 10 has a bottom surface 20 that is a flat surface. The cup holder 10 also has an open top 22 and a body wall 24 extending between the bottom surface 20 and the open top 22. The body wall 24 includes an inner surface 26 defining a cavity 28 for receiving a beverage container 30. The beverage container 30 is a cup suitable for holding a liquid beverage and in one embodiment is made of flexible material such as paper or plastic.

The body wall 24 includes an outer surface 32 having a plurality of clamps extending from the outer surface 32 of the body wall 24. The plurality of clamps are shown as three clamps referred to as a first clamp 34*a*, second clamp 34*b* and third clamp 34*c* arranged vertically and adjacent to each other and in contact with each other. The first clamp 34*a* has a first surface area, the second clamp 34*b* has a second surface area 36*b* and the third clamp 34*c* has a third surface area 36*c*. The first surface area 36*a* is smaller than the second surface area 36*b* and the third surface area 36*c* is larger than the second surface area 36*b*. The differences in the size of the first surface area 36*a*, second surface area 36*b* and third surface area 36*c* allows for the first clamp 34*a*, second clamp 34*b* and third clamp 34*c* to accommodate different sized rails 14*a*, 14*b* of the luggage 12. Also, a lot of rails for luggage are made of several telescopic sections, where the largest section is typically at the lowermost point, therefore having the largest surface area closest to the bottom surface 20 is desirable. If for example the rail is too large to be grasped by the smallest surface area, first surface area 36*a* of first clamp 34*a*, then the second surface area 36*b* of second clamp 34*b* or third surface area 36*c* of third clamp 34*a* are larger in size and can accommodate a larger size rail. The first clamp 34*a*, second clamp 34*b* and third clamp 34*c* are all flexible.

Within the cavity 28, extending from the surface of the inner surface 26 of the body wall 24 are a plurality of cup stabilizers extending from the body wall into the cavity. More specifically there is shown a first cup stabilizer 38*a*, second cup stabilizer 38*b* and third cup stabilizer 38*c* arranged adjacent in contact with each other in a stacked manner. The first cup stabilizer 38*a* has a first surface area extending into the cavity 28, the second cup stabilizer 38*b* has a second surface area extending into the cavity 28 and the third cup stabilizer 38*c* has a third surface area extending into the cavity 28. The first surface area of the first cup stabilizer 38*a* is larger than the second surface area of the second cup stabilizer 38*b*. The third surface area of the third stabilizer 38*c* is smaller than the second surface area of the second cup stabilizer 38*b*. The cup stabilizers 38*a-c* each have an arcuate shape of different size that is configured to press into the side of the beverage container 30 when inserted into the cavity 28 in order to releasably secure the beverage container 30 with a friction fit. However, beverage containers can be different sizes and shapes so each cup stabilizer 38*a*, 38*b*, 38*c* each has a different size surface area to accommodate different size beverage containers. While three cup stabilizers are shown it is within the scope of this invention for a greater or lesser number of cup stabilizers to be present depending on the size of the cavity 28 and the intended size of the beverage container that will be inserted into the cavity 28.

Figure 6:
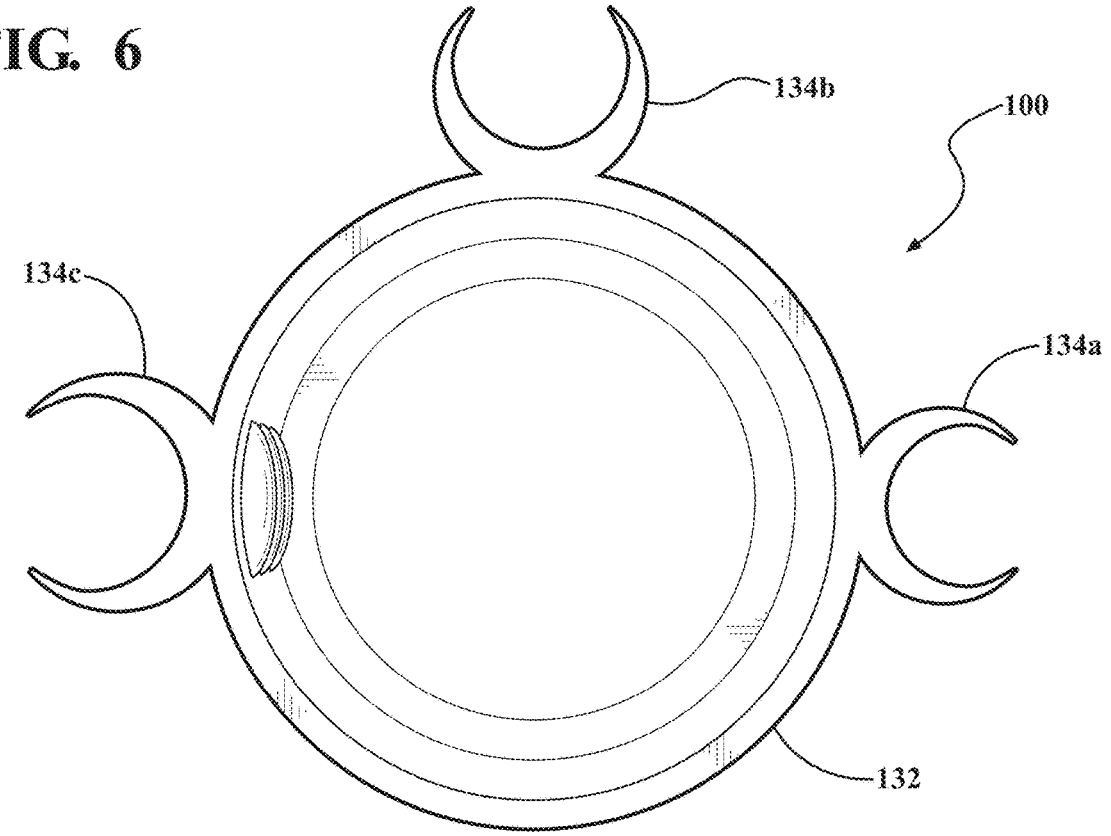
FIG. 6 is a top plan view of a cup holder according to an alternate embodiment of the invention.

FIG. 6 shows another alternate embodiment of a cup holder 100 with an outer wall 132 having a first clamp 134*a*, second clamp 134*b* and third clamp 134*c* each positioned at different locations around the radius of the outer wall 132. The first clamp 134*a*, second clamp 134*b* and third clamp 134*c* are each flexible and have a different shape for grasping rails having different shapes by allowing a user to rotate the cup holder 100 to a clamp having the appropriate size.

Figure 7:
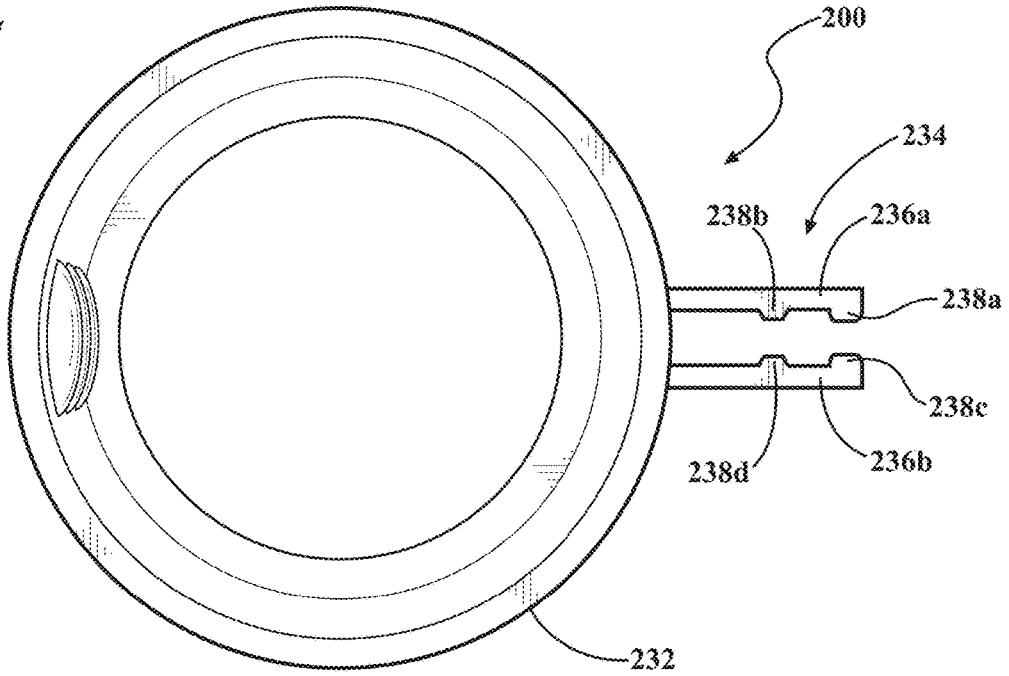
FIG. 7 is a top plan view of a cup holder according to an alternate embodiment of the invention.

FIG. 7 is another alternate embodiment of a cup holder 200 with an outer wall 232 having a clamp 234 extending from the outer wall. The clamp has two flexible arms 236*a*, 236*b*, and each have teeth 238*a*, 238*b*, 238*c*, 238*d* that resiliently grasp luggage rails of different size. Also, between the teeth 238*a*, 238*b*, 238*c*, 238*d* are spaces that make the clamp 234 more suitable for holding rails that have a square cross shape.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cup holder for a luggage comprising:

a bottom surface;

an open top;

a body wall extending between the bottom surface and the open top, where in the body wall includes an inner surface defining a cavity for receiving a beverage container and an outer surface;

a plurality of clamps extending from the outer surface of the body wall and arranged adjacent and in contact with each other, wherein the plurality of clamps engage with a rail on the luggage to connect the cup holder to the luggage, and a plurality of cup stabilizers extending from the inner surface of the body wall, the plurality of cup stabilizers are arranged adjacent and in contact with each other, wherein a first one of the plurality of cup stabilizers has a surface area that is larger than a second one of the plurality of cup stabilizers.

2. A cup holder for a luggage comprising:

a bottom surface;

an open top;

a body wall extending between the bottom surface and the open top, where in the body wall includes an inner surface defining a cavity for receiving a beverage container and an outer surface;

a plurality of clamps extending from the outer surface of the body wall, wherein the plurality of clamps engage with a rail on the luggage to connect the cup holder to the luggage, and a plurality of cup stabilizers extending from the inner surface of the body wall wherein the plurality of cup stabilizers are arranged adjacent and in contact with each other, and a first one of the plurality of cup stabilizers has a surface area that is larger than a second one of the plurality of cup stabilizers.

3. The cup holder for luggage of claim 1 further comprising a flexible clamp extending from body wall, wherein the flexible clamp resiliently clasps the rail that is connected to luggage.

4. The cup holder for luggage of claim 2, wherein a first one of the plurality of the clamps has a first surface area and a second one of the plurality of clamps has a second surface area, wherein the first surface area is larger than the second surface area.

5. The cup holder for luggage of claim 2, wherein a first one of the plurality of clamps has a first surface area and a second one of the plurality of clamps has a second surface area, wherein the second surface area is larger than the first surface area.

* * * * *